United States Patent [19]

Moore

[11] 4,420,850

[45] Dec. 20, 1983

[54] BACK WASHING DEVICE

[76] Inventor: Larry E. Moore, Box 96, Osage Beach, Mo. 65065

[21] Appl. No.: 340,313

[22] Filed: Jan. 18, 1982

[51] Int. Cl.[3] ..... A61H 33/00

[52] U.S. Cl. ..... 15/21 R; 4/606; 15/97 R

[58] Field of Search ..... 15/21 R, 21 B, 21 C, 15/97, 160, 210, 26; 4/606; 128/62 R

[56] References Cited

U.S. PATENT DOCUMENTS

| | | |
|---|---|---|
| 18,349 | 10/1857 | Miller . |
| 559,434 | 5/1896 | Bloemker . |
| 2,730,737 | 1/1956 | Herman . |
| 2,901,760 | 9/1959 | Nelson . |
| 3,078,484 | 2/1963 | Briggs . |
| 3,085,269 | 4/1963 | Greer . |
| 3,109,177 | 11/1963 | Grafmyer . |
| 3,750,226 | 8/1973 | Morgan . |

FOREIGN PATENT DOCUMENTS

| | | | |
|---|---|---|---|
| 316125 | 11/1956 | Switzerland | 15/26 |
| 546700 | 7/1942 | United Kingdom | 15/26 |

*Primary Examiner*—Edward L. Roberts

*Attorney, Agent, or Firm*—Litman, Day & McMahon

[57] ABSTRACT

A device for back washing and the like including a guide assembly with a front panel having a zigzag slot therethrough comprising a plurality of interconnected, alternating, sloped runs. A traveler assembly is mounted on the guide assembly and is movable along the runs. The traveler assembly includes a mounting block with a guide pin extending therefrom and having a retainer attached thereto for retaining the guide pin slidably positioned within the slot. A pad or brush is detachably mounted on the mounting block for engagement by a person simultaneously with the traveler assembly moving on the guide assembly.

16 Claims, 7 Drawing Figures

BACK WASHING DEVICE

BACKGROUND OF THE INVENTION

1. Field of the Invention

This invention relates to a device for back washing and the like, and in particular to a device operated by engagement with a user.

2. Description of the Prior Art

In the field of personal hygiene, an anatomically related problem exists for most persons in washing those portions of their bodies which are difficult to reach, especially the back region. It is well known that massaging and rubbing the back region is both pleasurable and beneficial, particularly because of the several large muscle groups located thereat. These muscle groups are prone to stiffness and soreness from certain physical activities, and are difficult to manually massage by oneself.

Consequently, a variety of prior art structures have been devised which attempt to address these problems. For example, the Nelson U.S. Pat. No. 2,901,760 and the Briggs U.S. Pat. No. 3,078,484 both disclose devices which may be adjustably positioned on a wall over a bathtub or in a shower enclosure and which are adapted for engaging a bather's back. However, such devices do not automatically move relative to a person's back, and their locking means must be disengaged for repositioning to accomplish a thorough back washing.

It is also known to mount a brush and the like on a guide and to provide a handle and cord system for moving the brush up and down over a bather's back. Such structures are exemplified in the Bloemker U.S. Pat. No. 559,434 and the Grafmyer U.S. Pat. No. 3,109,177. However, the relative complexity of such mechanisms is a disadvantage to the extent that they are more costly to produce than simpler devices. Also, they must be mounted in such a way as to withstand the pulling forces associated with their use.

Another type of back washing device using electric motors for imparting a rotary motion to a brush is exemplified in the Herman U.S. Pat. No. 2,730,737, although the real or imagined shock hazard associated with introducing electrical current into a bath enclosure in the presence of water and steam may be objectionable to many persons. The shower brush shown in Greer U.S. Pat. No. 3,085,269 avoids the electrical shock hazard by utilizing a water turbine for rotating the brush, but requires a plumbing hook-up.

Therefore, prior art back washing devices have tended to be relatively complex in structure and in manufacture, necessitating a relatively high cost to the user, or ineffective and inconvenient in operation.

SUMMARY OF THE INVENTION

In the practice of the present invention, a device for back washing and the like is provided which is simple in construction, actuated by a user and by gravity, and effective for cleaning and massaging a person's entire back area. A guide assembly is provided having a front panel with a slot including a plurality of interconnected, alternating, slanted runs. The front panel displays inner and outer faces and a mounting block is mounted adjacent the front panel outer face by a guide pin movably positioned in the slot. A retainer is mounted on the guide pin adjacent the front panel inner face for retaining the guide pin in the slot. Engagement means such as a brush, sponge or the like is attached to the mounting block and is engageable by a person simultaneously with the traveler assembly moving relative to the front panel. A thorough cleansing of a bather's back is effected as the traveler assembly traverses the runs, causing the engagement means to move from side to side and downwardly under the influence of gravity while simultaneously engaging the bather.

The principal objects of the present invention are: to provide a device for back washing and the like which washes and massages substantially the entire back area of a user; to provide such a device which is actuated by the user and by gravity; to provide such a device which includes a guide assembly having a zigzag slot and a traveler assembly movable along said slot; to provide such a device wherein the traveler assembly includes engagement means for engaging a person; to provide such a device which is adapted for use with a plurality of engagement means; to provide such a device wherein the traveler assembly is simultaneously engageable by a user and movable from side to side and downwardly with respect to the guide assembly; to provide such a device wherein the traveler assembly includes a mounting block having the engagement means detachably mounted thereon; to provide such a device adaptable for use with a plurality of different engagement means; to provide such a device which is easily cleaned and sanitary to use; to provide such a device with relatively few moving parts; to provide such a device wherein the guide assembly may be easily and securely mounted on a wall or the like; to provide such a device with engagement means adapted for receiving and applying soap to a person; to provide such a device which is particularly well adapted for use adjacent a bathtub or in a shower enclosure; and to provide such a device which is economical to manufacture, efficient in use, capable of a long operating life, and particularly well adapted for the proposed use.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DESCRIPTION OF THE PREFERRED EMBODIMENTS

Figures 1, 2, 3, 4, 5, 6, 7:
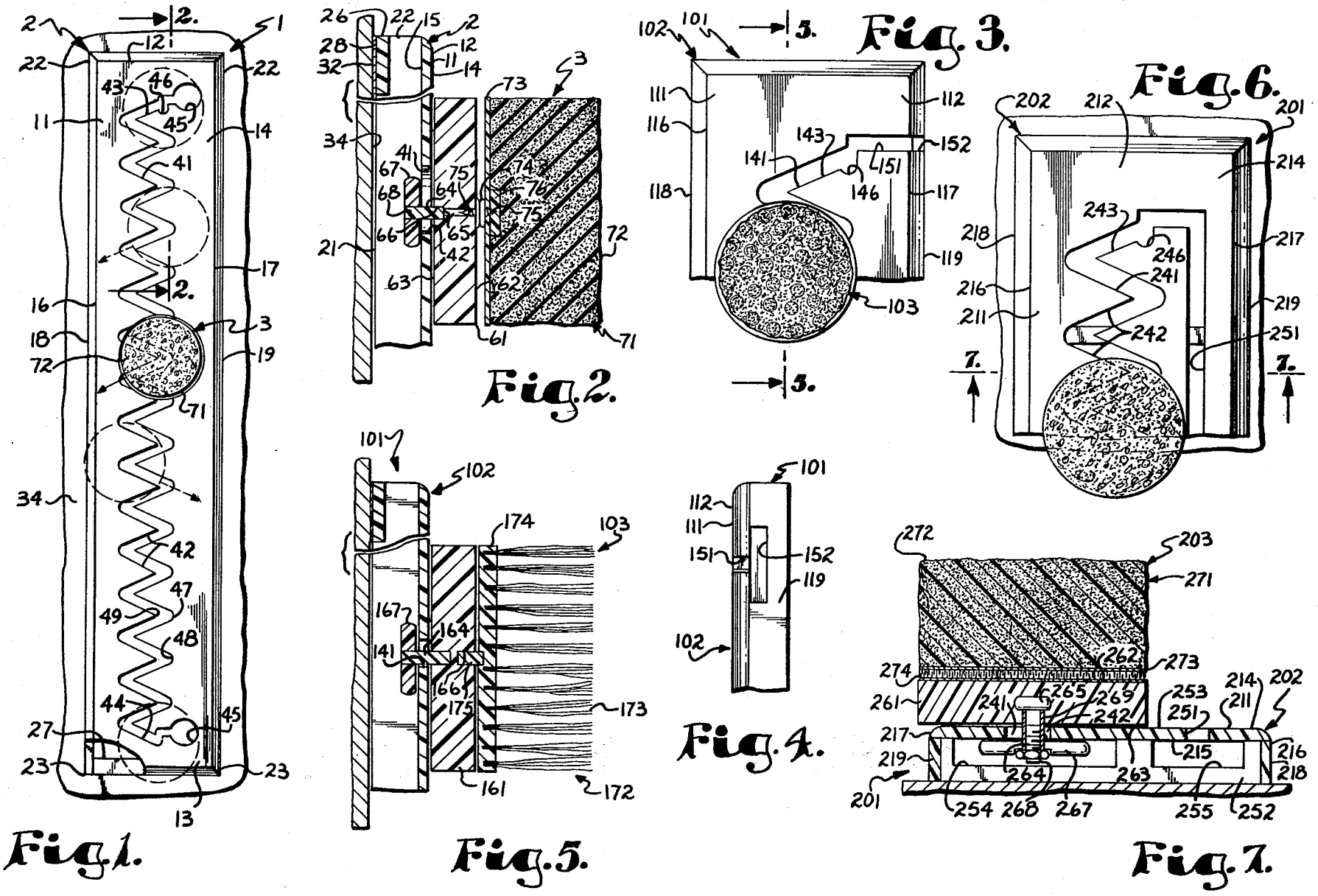
FIG. 1 is a front elevational view of a device for back washing and the like embodying the present invention.
FIG. 2 is an enlarged, fragmentary cross-sectional view of the back washing device taken generally along line 2—2 in FIG. 1 and particularly showing a traveler assembly.
FIG. 3 is an enlarged, fragmentary, front elevational view of a first modified embodiment of the present invention.
FIG. 4 is an enlarged, fragmentary, side elevational view of the first modified embodiment particularly showing a retainer opening.
FIG. 5 is an enlarged, fragmentary, vertical cross-sectional view of the first modified embodiment taken generally along line 5—5 in FIG. 3 and particularly showing a traveler assembly.
FIG. 6 is an enlarged, fragementary front elevational view of a second modified embodiment of the present invention.
FIG. 7 is an enlarged, transverse cross-sectional view of the second modified embodiment taken generally along line 7—7 in FIG. 6 and particularly showing a traveler assembly.

As required, detailed embodiments of the present invention are disclosed herein, however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

For purposes of description herein, the terms "upper," "lower," "front," "rear," "vertical," "horizontal," and derivatives thereof shall relate to the invention as oriented in FIG. 1 for the primary embodiment, FIG. 3 for the first modified embodiment, and FIG. 6 for the second modified embodiment. However, it is to be understood that the invention may assume various alternative orientations, except where expressly specified to the contrary.

Referring to the drawings in more detail, the reference numeral 1 generally designates a back washing device primarily comprising a fixed-position guide assembly 2 and a traveler assembly 3 movably mounted thereon.

The guide assembly 2 includes a front panel 11 having an upper and a lower end 12 and 13 respectively and displaying outer and inner faces 14 and 15. A pair of side walls 18 and 19 are integrally connected to and extend rearwardly from the front panel 11 at opposite side margins 16 and 17 thereof. The side walls 18 and 19 each terminate at a back edge 21 and have an upper and a lower end 22 and 23 respectively.

Upper and lower mounting bars 26 and 27 respectively are attached to and extend between the side walls 18 and 19 adjacent their respective upper and lower ends 22 and 23. Each mounting bar 26 and 27 displays a back face 28 positioned substantially flush with the side wall back edges 21.

A strip of water-proof, two-sided tape 32 is secured to the back face 28 of the upper mounting bar 26 and to the back face (not shown) of the lower mounting bar 27. The tape strips 32 are adapted for securing the guide assembly 2 in a fixed position on a wall 34, preferably in a shower enclosure or over a bathtub (not shown). Although two-sided tape is shown, other fastening means may be employed to attach the guide assembly 2 to the wall 34. Without limitation on the generality of useful fastening means, such means may also comprise waterproof adhesive, suctions cups, hook and loop type fasteners, screws and nails. However, the two-sided tape strips 32 have been found to be particularly useful for attaching the guide assembly 2 to walls having a variety of surface materials, including cermamic tile, fiberglass and metal.

A guide slot 41 is formed through the front panel 11 between its respective outer and inner faces 14 and 15 and extends between the front panel upper and lower ends 12 and 13 respectively. The guide slot 41 comprises a plurality of alternating, slanted, interconnected runs 42 defining a generally zigzag configuration. The uppermost and lowermost runs 43 and 44 respectively each terminate in an enlarged retainer opening 45 through the front panel 11. A retaining notch 46 is positioned in slightly spaced relationship from the respective retainer opening 45 at the front panel upper end 2 and communicates with the uppermost run 43. The runs 42 are interconnected at intersections 47 positioned in spaced relation inwardly from the front panel side margins 16 and 17. Each intersection 47 is defined by a rounded outer radius 48 and an inner angle 49.

The traveler assembly 3 comprises a mounting block 61 with a shallow cylindrical configuration and outer and inner faces 62 and 63 respectively. A guide pin 64 extends from the mounting block inner face 63 in a direction substantially normal thereto and has an outer end 65 fixedly secured to the mounting block 61 in a bore 66 extending coaxially therethrough. The guide pin 64 has a slightly smaller diameter than the width of the slot 41 and the spacing between each outer radius 48 and the respective inner angle 49. A disc-shaped retainer 67 is mounted on an inner end 68 of the guide pin 64 in spaced relation from the mounting block inner face 63. The retainer 67 is slightly smaller than the retainer openings 45.

Engagement means 71 comprises a resilient pad 72 of sponge-like material having a generally cylindrical configuration and a rigid backing 73. The pad 72 is detachably mounted on the mounting block 61 adjacent its outer face 62 by a conventional snap fastener 74 attached to the mounting block 61 by a screw 75 extending into the mounting block bore 66. A screw 75 extending through the backing 73 and into a reinforcement 76 attaches the snap fastener 74 to the pad 72. The pad 72 is adapted to retain soap and water and to apply same to a person coming in contact therewith.

The retainer 67 slidably engages the front panel inner face 15 and functions to maintain the guide pin 64 slidably or rotatably positioned within the slot 41. The mounting block inner face 63 slidably engages the front panel outer face 14. Preferably, the guide pin 64 maintains the mounting block inner face 63 and the retainer 67 in a spaced relationship slightly greater than the thickness of the front panel 11. Thus, the mounting block 61 is maintained in position with its outer face 62 and the engagement means 71 mounted thereon facing outwardly in a direction substantially normal to the front panel outer face 14.

In use, the guide assembly 2 is mounted on the wall 34 by means of the tape strips 32. Preferably, the guide assembly upper end 12 is at about neck or shoulder height for an intended user. The traveler assembly 3 is movably mounted on the guide assembly 2 by extending the retainer 67 through the opening 45 at the front panel upper end 12 and aligning the guide pin 64 with the uppermost run 43. The traveler assembly 3 may then be moved to a position whereat the guide pin 64 is received in the retainer notch 46, whereby the traveler assembly 3 will be supported at the front panel upper end 12. The engagement means 71 is then detached from the mounting block 61, lathered up with soap and water and reattached to the mounting block 61. Alternatively, the entire traveler assembly 3 may be removed from the guide assembly 2 or the engagement means 71 and mounting block 61 left on the guide assembly 2 for lathering up the engagement means 71.

For back washing, a person then slides the traveler assembly 3 on the guide assembly 2 whereby the guide pin 64 is lifted from the retaining notch 46 and placed in the uppermost run 43. The bather then turns around and allows the engagement means 71 to come to rest on the upper part of his or her back and begins a slow side-to-side rocking motion while maintaining a gentle pressure against the engagement means 71 with the back. In synchronization with the side-to-side and downward movement of the traveler assembly 3 as it follows the zigzag guide slot 41, the user slides his or her back completely across the engagement means 71 as the traveler assembly 3 traverses each slanted run 42. The engagement means 71 is positioned barely in contact with the side of the back at the completion of each run of the engagement means 71 thereacross. Thus, complete coverage of the back is provided and the traveler assembly 3 is properly positioned with its guide pin 64 at an intersection 47 for the next pass along the next lower run 42. In this, manner, substantially the entire back area of a person will be simultaneously washed and massaged with the scrubbing action of the pad 72, including portions which are difficult or impossible to reach by hand. Upon reaching the front panel lower end 13, the traveler assembly 3 may be removed from the guide assembly 2 by withdrawing the retainer 67 through the opening 45 at the front panel lower end 13, and the process may be repeated.

The simultaneous side to side and downward movement of the traveler assembly 3 following the zigzag guide slot 41 is caused by the combined forces of gravity acting thereon and the side to side movement of a bather. Although the traveler assembly 3 will negotiate the course defined by the guide slot 41 under the influence of gravity alone without manual assistance, a more thorough and pleasurable back wash and massage may generally by effected by the bather moving his or her body from side to side while applying a gentle pressure with the back against the engagement means 71. For example, as the traveler assembly 3 moves along a run 42, the bather should lean or rock sideways in the same general direction but further than the movement of the traveler assembly 3. Thus, the pad 72 will rub substantially across the entire width of the bather's back. When properly used for maximum benefit and enjoyment, the pad 72 will be positioned at one side of a person's back when the guide pin 64 is at each intersection 47 in the guide slot 41. Then, the bather moves in the same direction as the traveler assembly 3 does in negotiating the next run 42, and ends with the pad 72 at the other side of the back. In this manner, substantially the entire back area is covered by the cooperation between the bather rocking from side to side and the traveler assembly 3 moving only a few inches from side to side as it follows the zigzag course of the slot 41.

In addition to thoroughly cleansing the user's back, the several large muscle groups present thereat are effectively massaged by the action of the device 1, thus relaxing as well a cleansing the bather. The beneficial effects of such a back massage will be appreciated, because these muscle groups are particularly susceptible to tightness and soreness resulting from tension, fatigue or physical exertion.

A plurality of engagement means 71 may be provided with the back washing device 1 and readily attached to and detached from the mounting block 61. For example, each of a plurality of users of the back washing device 1 may have an individual engagement means 71 for personal use. Also, a non-skid material may be provided on the traveler assembly 3 or the front panel 11 to provide a braking action if a bather separates from the engagement means 71. In this manner, the traveler assembly 3 will be prevented from moving along the guide slot 41 under the influence of gravity alone. Thus, the bather could step away from the back washing device 1, leave the traveler assembly halted in its course, and subsequently reengage the engagement means 71 to continue back washing without having to return the traveler assembly 3 to its starting position.

A back washing device comprising a first modified embodiment of the present invention is shown in FIGS. 3, 4 and 5 and is generally designated by the reference numeral 101. The back washing device 101 comprises a guide assembly 102 with a traveler assembly 103 detachably and movably mounted thereon.

The guide assembly 102 comprises a front panel 111 with upper and lower ends 112 and 113 and opposite side margins 116 and 117. A guide slot 141 extends through the front panel 111 and terminates in a horizontal slot 151 at the panel upper end 112 which extends from an uppermost run 143 to the front panel side margin 117.

Side walls 118 and 119 are integrally connected to the front panel 111 at its side margins 116 and 117 respectively and extend rearwardly therefrom. The side wall 119 has a retainer opening 152 extending therethrough and communicating with the horizontal run 151. The front panel and side wall lower ends (not shown) have a substantially similar horizontal run and opening (also not shown). The traveler assembly 103 may be slidably mounted on the guide assembly 102 by inserting a retainer 167 through the opening 152, and sliding a guide pin 164 through the horizontal run 151 to a retaining notch 146, whereat the traveler assembly 103 is positioned to negotiate the uppermost run 143 when started by a bather. Similarly, the traveler assembly 103 is removed from the guide assembly 102 through a substantially identical horizontal run and opening at its lower end (not shown).

The traveler assembly 103 includes engagement means 171 comprising a brush 172 having bristles 173 fixedly mounted on and extending in a direction substantially normal to a backing 174. The brush 172 is secured to a mounting block 161 by means of a mounting pin 175 extending from its backing 174 in a direction substantially normal thereto and into a bore 166 extending coaxially through the mounting block 161. The mounting pin 175 is securely received within the bore 166 in a tight, frictional engagement, whereby the brush 172 will be secured to the mounting block 161 for bathing purposes and may be removed therefrom for replacement.

In use, the back washing device 101 of the first modified embodiment functions in a manner substantially similar to that of the back washing device 1 of the primary embodiment, except for the function of the guide assembly 102 for attachment and removal of the traveler assembly 103 as heretofore described.

A back washing device comprising a second modified embodiment of the present invention is shown in FIGS. 6 and 7 and is generally designated by the reference numeral 201. The back washing device 201 includes a guide assembly 202 with a traveler assembly 203 movably mounted thereon. The guide assembly 202 includes a front panel 211 with an upper end 212, a lower end (not shown), outer and inner faces 214 and 215 and opposite side margins 216 and 217. Opposite side walls 218 and 219 are integrally connected to the front panel 211 at its side margins 216 and 217 respectively and extend rearwardly therefrom. A slot 241 extends through the front panel 211 and comprises a plurality of interconnected, alternating sloped runs 242, an uppermost run 243 and a lowermost run (not shown). A retaining notch 246 for supporting the traveler assembly 203 at a predetermined position is provided in the uppermost run 243. A vertical return run 251 extends generally parallel to and in spaced relation between the runs 242 and the front panel side margin 217 and communicates the uppermost run 243 and the lowermost run (not shown). In use, the traveler assembly 203, having reached the lowermost run (not shown), is slid laterally therealong to the return run 251 and then slid by hand upwardly along the return run 251 to the uppermost run 243 whereat the retaining notch 246 will receive a guide pin 264 of the traveler assembly 203. The traveler assembly 203 is thus in place for reuse.

The traveler assembly 203 comprises a mounting block 261 having an outer and inner faces 262 and 263 respectively. The guide pin 264 comprises a bolt with a head 265 embedded in the mounting block 261 and a threaded inner end 268. The guide pin 264 receives a spacer 269 thereon which engages the mounting block inner face 263 and functions to maintain a retainer 267 in a predetermined spaced relationship therefrom slightly greater than the thickness of the front panel 211, whereby the traveler assembly 203 is allowed to freely slide with respect to the guide assembly 202.

Engagement means 271 is detachably mounted on the mounting block 261 and includes a pad 272 comprising a resilient, sponge-like material. Attachment means for detachably mounting the pad 272 to the mounting block 261 comprises a hook and loop type fastener, such as that available under the trademark Velcro with pieces 273 and 274 mounted on the mounting block outer face 262 and the pad 272 respectively.

The guide assembly 202 includes a plurality of braces 252 extending in spaced relationship transversely across the front panel inner face 215 and attached to the side walls 218 and 219. The braces 252 function to secure a central portion 253 of the front panel 211 which is surrounded by the guide slot 241 and the return run 251, and which is otherwise unattached to any portion of the front panel 211. Each brace 252 includes a first cut-out 254 to allow the retainer 267 to pass therethrough when negotiating the zigzag runs 242 and a second cut-out 255 to allow the retainer 267 to pass therethrough when slid along the return run 251.

The back washing device 201 comprising the second modified embodiment functions in a substantially similar manner as the primary and first modified embodiments 1 and 101 as previously described, with the exception of the means provided for returning the traveler assembly 203 from its finish position to its starting position.

Although plastic has been found to be well adapted for the construction of most parts of the back washing devices 1, 101, and 201, it will be appreciated that a variety of other materials might be successfully employed in the construction thereof.

Similarly, a variety of alternative engagement means may be provided in lieu of those shown having the pads 72 and 272 and the brush 172. For example, natural sponges may be successfully employed, or coarser materials may be utilized for a more vigorous scrubbing effect.

It is to be understood that while certain forms of the present invention have been illustrated and described herein, it is not to be limited to the specific forms or arrangement of parts described and shown.

I claim:

1. A device for back washing and the like, which comprises:

(a) a guide assembly having a panel with a slot extending therethrough, said slot comprising a plurality of interconnected, alternating slanted runs;

(b) a traveler assembly mounted on said guide assembly and movable along said runs, said traveler assembly including:

(1) a mounting block;

(2) a guide pin extending from said mounting block and through said slot;

(3) a retainer attached to said guide pin whereby said panel is positioned between said mounting block and said retainer with said guide pin in said slot; and (4) washing means mounted on said mounting block and engageable by a person.

2. The device according to claim 1 wherein:

(a) said washing means comprises a pad of resilient material.

3. The device according to claim 1 wherein:

(a) said washing means comprises a brush.

4. A device for back washing and the like, which comprises:

(a) a guide assembly including:

(1) a front panel having inner and outer faces; and (2) a slot extending through said front panel and comprising a plurality of interconnected, alternating runs;

(b) a traveler assembly mounted on said guide assembly and movable along said runs, said traveler assembly comprising:

(1) a mounting block positioned adjacent said front panel outer face;

(2) a guide pin extending from said mounting block and through said slot;

(3) a retainer attached to said guide pin adjacent said front panel inner face; and (4) washing means mounted on said mounting block, said washing means being engageable by a person simultaneously with said traveler assembly moving on said guide; and (c) guide assembly mounting means for mounting said guide assembly on a wall and the like.

5. The device according to claim 4 which includes:

(a) said slot terminating at upper and lower ends; and (b) upper and lower retainer openings in said guide assembly communicating with said slot upper and lower ends respectively, each said retainer opening being larger than said retainer.

6. The device according to claim 5 wherein:

(a) each said retainer opening is in said guide assembly front panel.

7. The device according to claim 5 which includes:

(a) said guide assembly including a pair of side walls integrally connected to said front panel and extending rearwardly therefrom;

(b) each of said retainer openings being positioned in one of said side walls.

8. The device according to claim 4 which includes:

(a) a downward opening notch communicating with said slot and adapted to receive said guide pin.

9. The device according to claim 4 which includes:

(a) said slot having upper and lower ends; and (b) a return slot extending between and interconnecting said slot ends, said return slot slidably receiving said guide pin.

10. The device according to claim 4 which includes:

(a) non-skid material mounted on one of said guide assembly front panel and said traveler assembly for retaining said traveler assembly in a fixed position with respect to said guide assembly when said washing means is disengaged by a person.

11. The device according to claim 4 which includes:

(a) a snap type fastener for detachably mounting said washing means on said mounting block.

12. The device according to claim 4 which includes:

(a) said mounting block having a bore extending thereinto; and (b) said washing means having a mounting pin receivable in said bore in a frictional engagement therewith.

13. The device according to claim 4 which includes:

(a) a hook and loop type fastener for detachably mounting said washing means on said mounting block.

14. A device for back washing and the like, which comprises:

(a) a guide assembly including:

(1) a front panel having inner and outer faces;

(2) a pair of side walls integrally connected to said front panel and extending rearwardly therefrom; and (3) a zigzag slot extending through said front panel and comprising a plurality of interconnected, alternating, slanted runs;

(b) a traveler assembly mounted on said guide assembly and movable along said runs, said traveler assembly comprising:

(1) a mounting block positioned adjacent said front panel outer face;

(2) a guide pin extending from said mounting block and through said slot;

(3) a retainer attached to said guide pin adjacent said front panel inner face; and (4) washing means mounted on said mounting block, said washing means being engageable by a person simultaneously with said traveler assembly moving along said slot;

(c) means for removing said guide pin from said slot whereby said traveler assembly may be raised from a finish position at a lower end of said front panel to a starting position at an upper end of said front panel; and (d) guide assembly mounting means for mounting said guide assembly on a wall and the like.

15. The device according to claim 14 wherein:

(a) said guide assembly mounting means includes waterproof adhesive attached to said guide assembly and attachable to said wall and the like.

16. The device according to claim 14 which includes:

(a) a downward opening notch communicating with said slot and adapted to receive said guide pin.

* * * * *